United States Patent [19]

Amancharla

[11] 4,188,999

[45] Feb. 19, 1980

[54] EXPENDABLE PLUG AND PACKER ASSEMBLY

[75] Inventor: Amareswar Amancharla, League City, Tex.

[73] Assignee: Baker International Corporation, Orange, Calif.

[21] Appl. No.: 946,228

[22] Filed: Sep. 27, 1978

[51] Int. Cl.[2] ..... E21B 33/12

[52] U.S. Cl. ..... 166/133; 166/135; 166/317

[58] Field of Search ..... 166/133, 188, 318, 319, 166/135

[56] References Cited

U.S. PATENT DOCUMENTS

| | | | |
|---|---|---|---|
| 2,928,469 | 3/1960 | Crowe | 166/135 |
| 3,002,563 | 10/1961 | Crowe | 166/135 |
| 3,131,765 | 4/1964 | Myers | 166/133 |
| 4,007,783 | 2/1977 | Amancharla et al. | 166/135 |

*Primary Examiner*—James A. Leppink

*Attorney, Agent, or Firm*—William C. Norvell, Jr.

[57] ABSTRACT

A well tool assembly is provided which is adapted to be set within a well bore. The assembly comprises a main body having a main passage. Means on the main body are provided for securing the main body within the well bore. An expendable plug is provided and housed within the passage to prevent flow of fluid therethrough. The plug assembly comprises a top sub, a longitudinally extending mandrel and piston means. First disengaging means are provided for selectively securing the top sub to the piston means or the mandrel. Second disengaging means are provided for selectively securing the top sub to the other of the piston means and the mandrel. Seal means are located on the plug assembly for prevention of fluid transmission thereacross. First and second no-go elements on at least one of the main body and the expendable plug are operational with third disengaging means which, in turn, are initially housed within the main body and between the no-go means, and initially secured to at least one of the piston means and the mandrel, the no-go means resisting upper and lower longitudinal movement of the third disengaging means.

24 Claims, 7 Drawing Figures

EXPENDABLE PLUG AND PACKER ASSEMBLY

BACKGROUND OF THE INVENTION

1. Field of the Invention

The present invention relates to an expending plug designed particularly for use in combination with well packers, bridge plugs and the like, the plug resisting pressure surges from above and below the plug assembly.

2. Description of the Prior Art

Plug assemblies have been utilized and installed within the lower portion of the central bore of a well packer or other apparatus for location within a subterranena well at a predetermined depth. The packer, with the plug in place within its bore, may be utilized to isolate a plurality of production zones within the well for selective treatment of one or more of the zones.

When the first or upper zone has been treated and it is desired to either produce through the packer bore or treat the second or lower zone, a tubing string, either plain ended, or with an apparatus such as a mule shoe or the like inserted at its lower end, is inserted within the well and through the bore of the packer assembly to disengage the plug assembly from the well packer such that it is expended from the packer to the bore and free falls to the bottom of the well. If th plug is retrieved to the top of the well, the tubing or production string must be reinserted into the well and located immediate the well packer for production of the upper zone or for subsequent treatment or production of one or more zones therebelow.

Plug assemblies typical of the prior art are disclosed in the following U.S. patents: U.S. Pat. No. 3,002,563, entitled "Convertible Well Packer", issued Oct. 3, 1961, T. L. Crowe, Inventor; U.S. Pat. No. 3,131,765 entitled "Convertible Well Packer and Bridge Plug", issued May 5, 1964, W. D. Myers, Inventor; and U.S. Pat. No. 4,007,783, entitled "Well Plug With Anchor Means", issued Feb. 15, 1977, Amareswar Amancharla, et al, Inventors. Although each is an advancement in the art, these prior art assemblies, when compared to the present invention, are somewhat cumbersome, complex, expensive and timely to manufacture.

The present invention obviates the difficiencies found in the prior art by providing a plug assembly which may be expended from the bore of a well packer or other apparatus in a single trip such that the tubing utilized to expend the plug also may be utilized to produce or treat a second and lower zone without requirement of retrieval of the tubing subsequent to the plug expending operation.

SUMMARY OF THE INVENTION

A well packer assembly is provided which is adapted to be set within a well bore. The assembly comprises a packer body having a main passage. Means are provided on the packer body for securing the packer body in a well bore, in known manner. An expendable plug is provided in the passage to prevent flow of fluid therethrough. In a preferred form, the enpendable plug comprises a top sub, a longitudinally extending mandrel carried interiorally of said top sub, and piston means between the top sub and the mandrel. Disengaging means are provided for selectively securing the top sub to said piston means. A plurality of expandable, normally inwardly contracted segmented ring elements are carried above the piston and between the top sub and the mandrel to selectively secure the piston to the mandrel. Seal means are provided to prevent fluid transmission across the plug assembly. Upper and lower no-go shoulders are provided on one of the packer body and the expendable plug. Segmented, normally expanded but contractible ring elements are carried between the no-go shoulders on the other of the packer body and the expendable plug.

DESCRIPTION OF THE PREFERRED EMBODIMENTS

Figure 1:
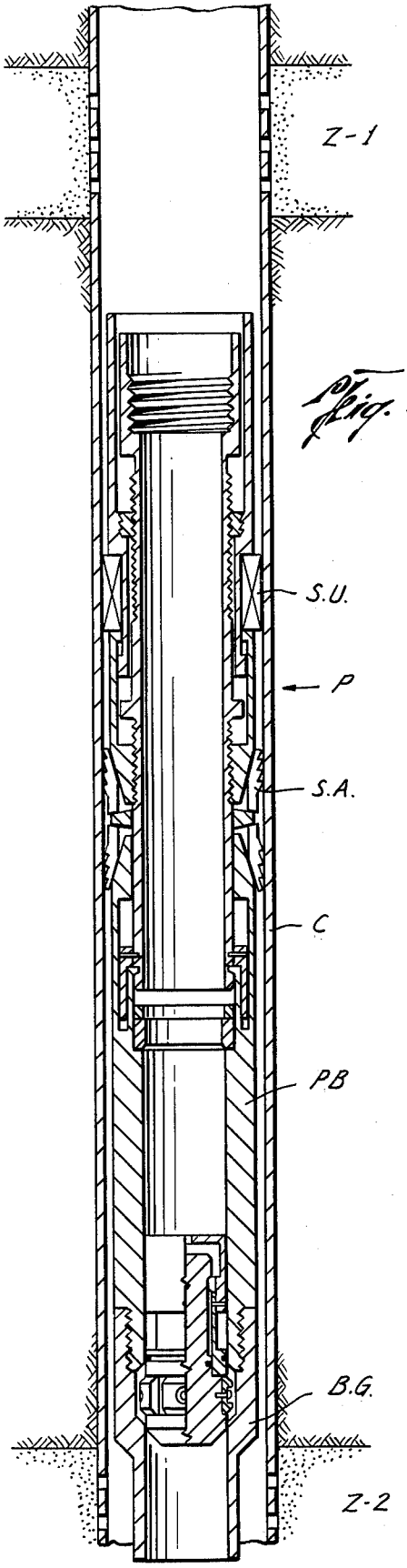
FIG. 1 is a longitudinal semi-schematic illustration of a packer assembly sealingly engaged within the casing of a subterranean well between upper and lower production zones prior to treatment of the upper production zone, with the expendible plug assembly in engaged position within the bore of the lower body of the packer assembly.

The plug assembly 100 is illustrated in FIG. 1 in set position between the bottom guide BG and the body PB of the packer assembly P. Prior to running the packer assembly into the well, the plug assembly 100 is inserted within the bore of the packer assembly P and run in place with the packer assembly P, which is set within the well between upper and lower production zones Z-1 and Z-2 by means of expansion and gripping engagement of the slip assembly SA with the interior of the casing C, a conventional elastomeric seal unit SU thereabove isolating the bore between the packer P and the casing C to enable isolation of the upper production Zone Z-1 for subsequent remedial or other treatment.

Figure 2:
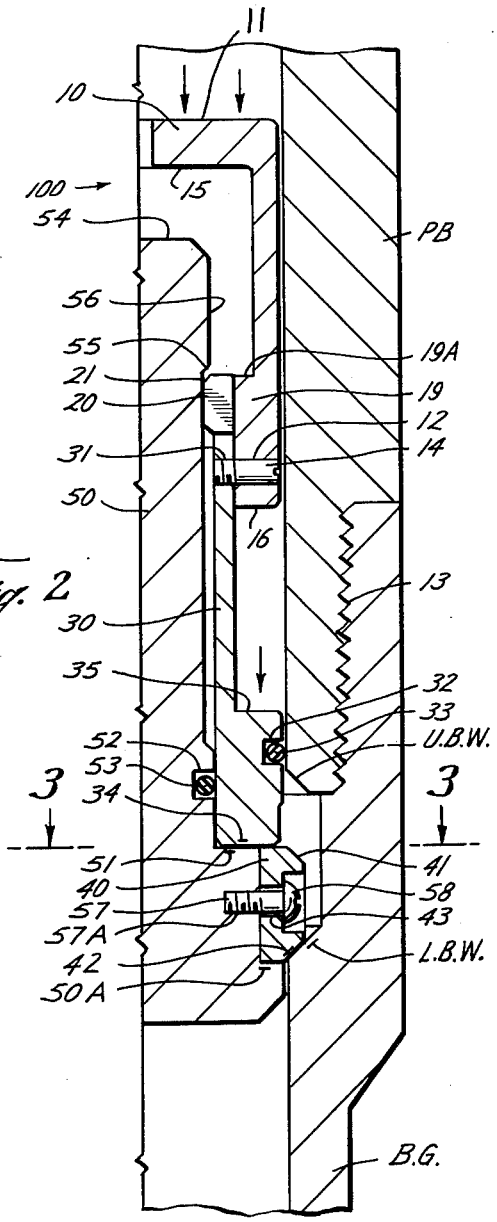
FIG. 2 is an enlarged longitudinal sectional view illustrating the expendable plug in engaged position within the packer and withholding a pressure surge from above the plug assembly.
Figure 3:
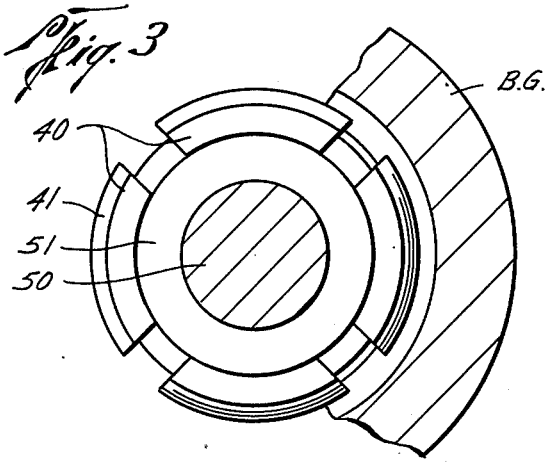
FIG. 3 is a cross-sectional view of the plug assembly taken along lines 3—3 of FIG. 2.

The plug assembly 100, as shown in FIG. 2, is assembled within and run in the packer assembly P, illustrated in FIG. 1, between the packer body PB and the bottom guide BG, with threads 13 securing the body PB to the guide BG.

Referring now to FIG. 2, the plug assembly 100 has at the upper end thereof a top sub 10 which is engaged by means of a shear pin 14 to a longitudinally extending piston element 30 which, in turn, has at its upper end a plurality of segmented rings 20 and which normally has its lower end 34 resting upon the shoulder 51 of a lower inwardly extending mandrel 50. Immediate the lowermost end of the mandrel 50 are a plurality of upper and lower bevelled, inwardly collapsible segments 40 secured to the lower mandrel 50 by means of a shear pin 57.

The top sub 10 has an upper end or face 11 upon which downward force is exerted through the lower end of the production tubing PT when the plug assembly 100 is expended from within the packer assembly P. An inner face 15 on the top sub 10 is provided for companion interface with the upper end 54 of the mandrel 50 as the production tubing PT continues lower longitudinal travel to expend the plug assembly 100. A bore 12 is defined latitudinally across the lower portion of the top sub 10 and transversely receives a shear pin 14 of predeterminable strength for receipt within a companion bore 31 within the piston 30 to secure the piston 30 to the top sub 10. The lower end 16 of the top sub 10 will contact a companion shoulder 35 on the piston 30 subsequent to shearing of the pin 14 during the plug expending operation. The top sub 10 also provides an extension 19 for normal abutment with the segmented rings 20, the extension 19 having an upper face or shoulder 19A which permits the rings 20 to expand outwardly for selective disengagement of the piston 30 and the mandrel 50.

Immediately above the piston 30 and between the lower mandrel 50 and the top sub 10 are a plurality of radially defined, inwardly contractable segmeted ring elements 20, each ring element 20 having an upper bevel 21 for companion interface with a bevelled shoulder 55 on the mandrel 5 during the expending operation. The segmented rings 20 are held in place between the mandrel 50 and the top sub 10 and above the piston 30 by means of the top sub 10 being shear pinned to the piston 30.

The piston 30 houses an elastomeric O-ring 33 within a circumferentially defined bore 32 to prevent fluid communication between the piston 30 and the packer body PB. The lower end 34 of the piston 30 rests upon the upper face of the segments 40. The piston 30 also has above the ring 33 an outwardly extending shoulder 35 for receipt of the lower end 16 of the top sub 10 when the top sub 10 is urged downwardly subsequent to the shearing of the pin 14 during the expending operation.

The mandrel 50 has an upper end 54 which receives the inner face 15 of the top sub 10 when the production tubing PT shifts the top sub 10 downwardly during the expending operation. A bevelled shoulder 55 also is provided on the mandrel 50 for companion interface with the upper bevel 21 of the segmented rings 20. An outer smooth wall 56 is circumferentially defined around the exterior of the mandrel 50 for interface with the segmented rings 20 as they pass above the bevelled shoulder 55 during the expending operation. The wall 56 terminates upwardly by means of a bevel and terminates lowerly by means of the bevelled shoulder 55. The bevelled shoulder 55, and wall 56, are functional for providing relocation of the segmented rings 20 during the expending operation of the plug assembly 100.

An elastomeric O-ring element 53 is circumferentially carried around the mandrel 50 within a companion bore 52, the ring 53 preventing fluid communication between the mandrel 50 and the piston 30. Additionally, the ring 53 and ring 33 define a seal within the plug assembly 100 which isolates the interior bore of the packer P between the production zones Z-1 and Z-2.

An outwardly extending shoulder 51 on the mandrel 50 receives the lower end 34 of piston 30. Exterior of the shoulder 51 and circumferentially spaced around the mandrel 50 are a plurality of segments 40 normally held in place and secured to the mandrel 50 by means of a shear pin 57 extending through a latitudinal bore 43 within each of the segments 40 and extending within a companion bore 57A in the mandrel 50. A head element 58 on the pin 57 assures securement of the segments 40 thereto.

Each of the segments 40 has an upper bevelled shoulder 41 which interfaces with a companion upper bevelled wall UBW on the packer body PB, if a pressure surge from below the plug assembly 100 urges the plug assembly 100 upwardly within the packer assembly P, the interface of the upper bevelled shoulder 41 and the upper bevelled wall UBW will prevent further upper longitudinal travel of the plug assembly 100 with respect to the packer body PB. Additionally, each of the segments 40 has a similarly defined lower bevelled shoulder 42 for companion interface with the lower bevelled wall LBW on the bottom guide BG in the event that a pressure surge from above the plug assembly 100 urges the assembly 100 downwardly within the packer assembly P, the shoulder 42-wall LBW interface preventing further longitudinal downward travel of the plug assembly 100 with respect to the packer assembly P.

It should be noted that the relationship of the bevelled wall LBW with respect to the rings 33 never permits the ring 33 to become sealingly disengaged from within the smooth inner wall of the packer body PB while the plug assembly 100 is in engaged position within the packer assembly P. Also, of course, when interface occurs between the upper bevelled shoulder 41 of the segments 40 and the upper bevelled wall UBW of the packer body PB, the ring 33 will be moved correspondingly upwardly, but still will remain sealingly engaged with the inner smooth wall of the packer body PB.

OPERATION

Referring now to FIG. 1, the packer assembly P is run on a tubing string (not shown) and is caused to be set within the casing C between the upper production zone Z-1 and the lower production zone Z-2, with the slip assembly SA anchoring against the casing C and the elastomeric seal unit SU sealingly engaged along the inner wall of the casing C. The plug assembly 100 is located within the packer assembly P, between the packer body PB and the bottom guide BG. The O-rings 53 and 33 in the plug assembly 100 provide a lower seal within the packer assembly P, (the upper end 54 of the mandrel 50 being solid), to isolate the interior of the packer assembly P from the production zone Z-2 and the interior of the well therebelow.

Referring to FIG. 2, if there is a pressure surge within the interior of the packer assembly P wherein the pressure above the rings 53 and 33 is higher than the pressure therebelow, the differential pressure across the rings 53–33 will cause the plug assembly 100 to be urged downwardly within the packer assembly P. However, lower travel of the plug assembly 100 is prevented upon interface of the lower bevelled shoulders 42 of the segments 40 with the lower bevelled wall LBW of the bottom guide BG before the ring 33 comes out of the inner bore of the packer body PB. The component parts of the plug assembly 100 will not become disengaged with respect to one another because the shear strength of each of the pins 14 and 57 will not be overcome by the differential pressure acting across the rings 53 and 33 because the load is carried across the lower bevelled wall LBW, across the segments 40 and the lower end 34 of the piston 30, then across the top end of the piston 30 to the lower end of the segments 30, then across the bevel 31 and the shoulder 55 of the mandrel 50.

Figure 4:
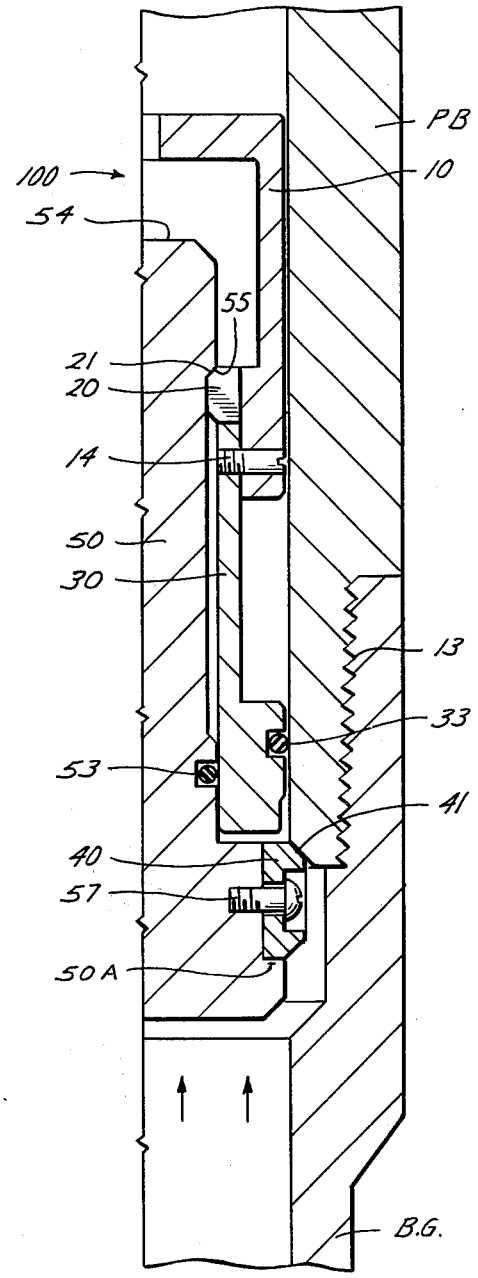
FIG. 4 is an enlarged longitudinal sectional view of the plug assembly, similar to that illustrated in FIG. 2, the plug assembly withholding a pressure surge from below the plug assembly.

Referring now to FIG. 4, if there is a differential pressure acting across the rings 53 and 33 as a result of a pressure surge from below the plug assembly 100 such that the pressure therebelow is higher than that above the rings 53–33 and within the plug assembly 100, the plug assembly 100 will be urged upwardly within the interior of the packer assembly P until such time as each of the upper bevelled shoulders 41 of the segments 40 interfaces with the companion upper bevelled wall UBW on the packer body PB. The 41-UBW interface will prevent further upper longitudinal travel of the plug assembly 100 within the packer assembly P. Again, the component parts of the plug assembly 100 will not become disengaged because the shear strength of the pins 14 and 57 will not be overcome because the hydraulic load on the piston 30 will be carried through the segments 20 and through the interface of the shoulders 21 and 55 to the mandrel 50. This load and the hydraulic force on the piston 50 will be transmitted through the segments 40 to the upper bevelled wall UBW.

Thus, the plug assembly 100 is stabilized such that even pressures as high as about 10,000 psi will fail to disengage the plug assembly 100 from within the packer assembly P and the packer bore will remain plugged.

Subsequent to the remedial or other treatment of the upper production zone Z-1, and when it is desired to expend the plug assembly 100 from within the bore of the packer assembly P to produce from or treat the lower production zone Z-2, an open ended string of production or other tubing PT is inserted within the casing C and through the bore of the packer assembly P for engagement upon the upper end 11 of the top sub 10. If the lower bevelled shoulders 42 of the segments 40 are not already interfaced with the lower bevelled wall LBW, they will be caused to so interface as the production tubing PT transmits a downward force upon the upper end 11 of the top sub 10, this force being transmitted through the top sub 10, the shear pin 14, the piston 30 and to the mandrel 50 and segments 40. Now, with the interface of the shoulders 42 an the lower bevelled wall LBW, the plug assembly 100 will resist further longitudinal lower travel. However, if the production tubing PT is continued to be moved downwardly, the shear strength of the shear pin 14 will eventually be overcome, and the pin 14 will shear, thus disengaging the top sub 10 from the piston 30.

When the top sub 10 moves downwardly with respect to the stabilized piston 30, the face 19*a* on the extension 19 of the top sub 10 will pass below the lower end of the segmented rings 20 such that resistance to outward radial expansion of the segmented ring 20 no longer is provided. Thus, subsequent to the face 19*a* passing below the lower end of the segmented rings 20, each of the rings 20 is permitted to expand circumferentially outwardly and away from the engaged position on the mandrel 50.

As the top sub 10 continues downward longitudinal movement, the inner face 15 of the upper end 11 of the top sub 10 interfaces with the upper end 54 of the mandrel 50 to carry the mandrel 50 longitudinally downwardly as a unit with the top sub 10. Now, the downward force of the production tubing PT acting on the top sub 10 is transmitted to the lower mandrel 50 by the 15-54 interface, this force also acting upon the shear pins 57 which engage the segments 40 to the mandrel 50. As downward force on the production tubing PT continues to be exerted upon the top sub 10 and the mandrel 50, the strength of the shear pins 57 is exceeded, and each of the pins 57 is sheared, disengaging the segments 40 from the mandrel 50.

Even though the segments 40 have become disengaged from the mandrel 50 as a result of the shearing of the pins 57 the segments 40 do not travel downwardly because of the 42-LBW interface. Accordingly, the mandrel 50 and the top sub 10 travel downwardly with the production tubing PT as a unit, with respect to the longitudinally stabilized segments 40 and the piston 30. As the top sub 10 and lower mandrel 50 move downwardly with respect to the stabilized segments 40, the shoulder 51 of the mandrel 50 and the lower end 34 of the piston 30 become separated, since the shear pin 14 no longer secures the piston 30 to the top sub 10 and further because the segmented rings 20 have expanded radially outwardly away from engagement with the mandrel 50. Thus, as the mandrel 50 and top sub 10 move downwardly, the piston 30 is shouldered upon the upper end of the segments 40 and is thus stabilized against longitudinal downward travel. As the shoulder 51 of the mandrel 50 passes below the lower end of each of the segments 40 the segments 40 are permitted to contract radially and rest inwardly on the shoulder 51 of the mandrel 50 such that the outside diameter of the segments 40 has become contracted and smaller than the inner diameter of the bottom guide BG.

During radial contraction of the segments 40, the piston 30 has remained in longitudinally stabilized position above the segments 40. However, even though the piston 30 has remained longitudinally stabilized, the top sub 10 and the mandrel 50 have continued lower longitudinal movement such that the lower end 16 of the top sub 10 now rests upon and is interfaced with the upper shoulder 35 of the piston 30, as illustrated in FIG. 5C.

When the shear pin 14 has been sheared and the top sub 10 moves downwardly to permit the segmented rings 20 to radially expand outwardly, the rings 20 are permitted to slide away from the mandrel 50 as the upper bevel 21 of the rings 20 slides with respect to the bevelled shoulder 55 to permit interface between the segmented rings 20 and the wall 56 of the mandrel 50. As the lower bevel 22 of the segmented rings 20 passes upwardly of the upper end 54, the inner face 15 of the top sub 10 will shoulder upon the upper end of the segmented rings 20 such that the segmented rings 20 are carried within the space defined between the upper end 15 of the top sub 10 and the upper end of the piston 30, as is illustrated in FIG. 5C. Thus, when the rings 20 rest upon the inner face 15, the piston 30 is permitted to shift longitudinally, thus enabling the segments 40 to become completely contracted above the shoulder 51 and around the mandrel 50 thereabove.

Figure 5A:
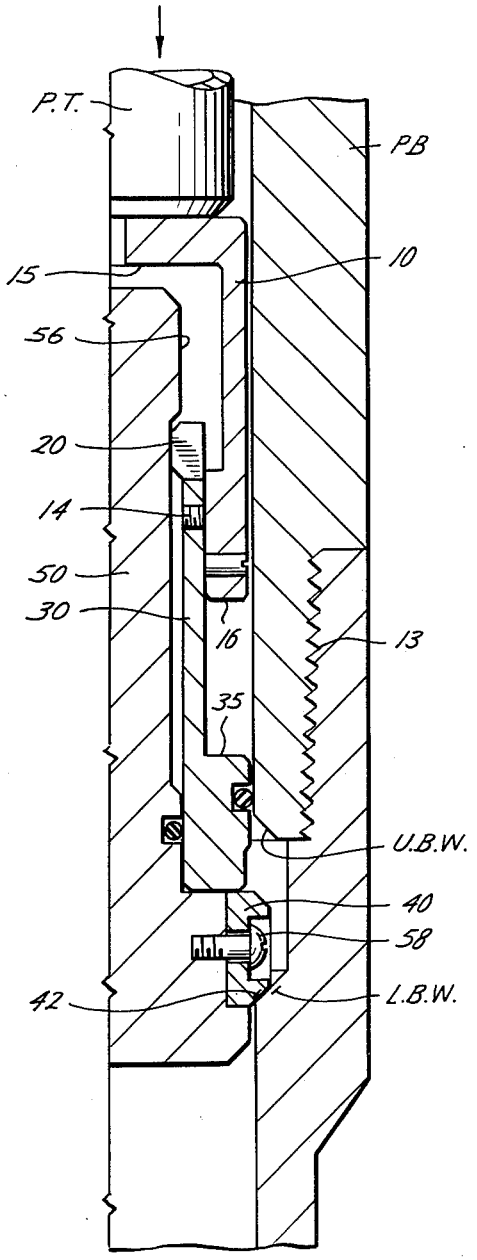
FIG. 5A is a longitudinal sectional view of the plug assembly with the lower end of production tubing being urged against the top sub of the plug assembly during the initial expending step.
Figure 5B:
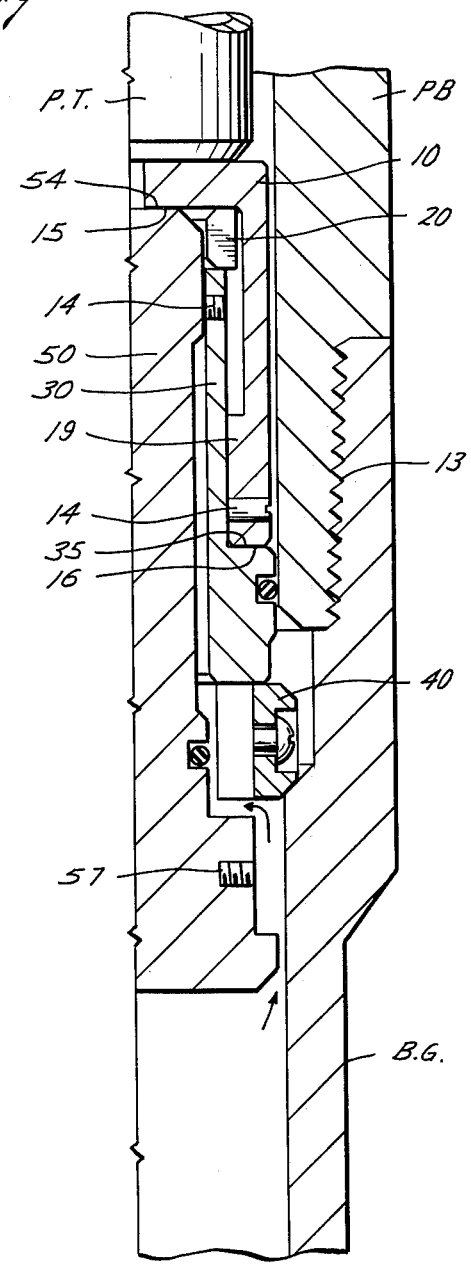
FIG. 5B is a longitudinal sectional view similar to that illustrated in FIG. 5A, showing continued expending of the plug assembly with the component parts being displaced from initial position.
Figure 5C:
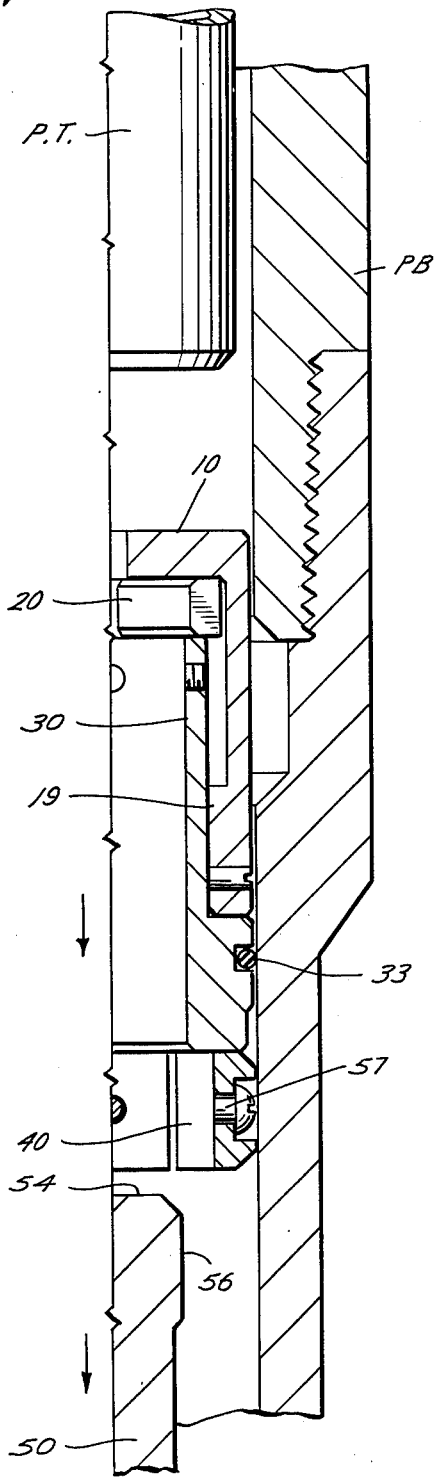
FIG. 5C is a longitudinal sectional view similar to those shown in FIGS. 5A, and B, illustrating the expendible plug being disengaged from within the packer assembly and being expended through the bottom guide of the packer for subsequent travel to the bottom of the well.

Now, the plug assembly 100 is in a collapsed position, as shown in FIG. 5C, and as the upper end 11 of the top sub 10 passes below the lowermost end of the bottom guide BG, as the production tubing PT continues to be urged through the packer assembly P, the plug assembly 100 will free fall within the casing P to the bottom of the well. Thereafter, the production tubing PT may be sealed and placed within the packer assembly P in a known manner and the production zone Z-1 produced or, alternatively, the production tubing PT may be inserted through the packer assembly P for treatment of the lower production zone Z-2, without requirement of retrieval of the production tubing PT to remove the plug assembly 100 therefrom.

It should be noted that as the plug assembly 100 component parts become disengaged from one another, as illustrated in FIG. 5B, pressure is permitted to equalize across the assembly 100. This is an obvious advantage in the design of the present invention and is quite desirable, inasmuch as if no pressure equalizing means are provided, additional force must be applied to the assembly 100 by means of the production tubing PT.

Although the invention has been described in terms of specified embodiments which are set forth in detail, it should be understood that this is by way of illustration only and that the invention is not necessarily limited thereto, since alternative embodiments and operating techniques will become apparent to those skilled in the art in view of the dislcosure. Accordingly, modifications are contemplated which can be made without departing from the spirit of the described invention.

What is desired to be secured by Letters Patent is:

1. A well tool assembly adapted to be set in a well bore, comprising: a main body having a passage; means on said main body for securing said main body in the well bore; an expendable plug in said passage to prevent flow of fluid therethrough, said plug comprising; a top sub; a longitudinally extending mandrel; piston means adjacent at least one of said top sub and said mandrel; first disengaging means for selectively securing said top sub to one of said piston means and said mandrel; second disengaging means for selectively securing said top sub to each of said piston means and said mandrel; seal means to prevent fluid transmission across said plug assembly; first and second no-go means on at least one of said main body and said expendable plug; and third disengaging means initially housed within said main body and between said no-go means, said third disengaging means being exterior of at least one of said piston means and said mandrel, said no-go means resisting upper and lower longitudinal movement of said third disengaging means.

2. The assembly of claim 1 wherein said first disengaging means secures said top sub to said piston means.

3. The assembly of claim 1 wherein said first disengaging means comprises a pin shearable upon application of pre-determined force on said plug.

4. The assembly of claim 1 wherein said seal means comprises a plurality of elastomerically sealing bodies circumferentially and exteriorally extending around at least one of said top sub, said piston means and said mandrel, at least one of said elastomerically sealing bodies initially sealingly engaging said main body, said elastomerically sealing bodies preventing fluid flow through said plug and said passage.

5. The assembly of claim 1 wherein said first and second no-go means comprise upper and lower shoulders.

6. The assembly of claim 1 wherein said first and second no-go means comprise upper and lower shoulders on said main body.

7. The assembly of claim 1 wherein said third disengaging means is carried on one of said mandrel, said top sub and said piston means.

8. The assembly of claim 1 wherein said third disengaging means is carried on said mandrel.

9. The assembly of claim 1 wherein said third disengaging means comprises segmented, normally expanded but contractible ring elements.

10. A well packer assembly adapted to be set in a well bore, comprising: a packer body having a passage; means on said packer body for securing said packer body in the well bore; an expendable plug in said passage to prevent flow of fluid therethrough, said plug comprising: a top sub; a longitudinally extending mandrel carried interiorally of said top sub; piston means between said top sub and said mandrel; disengaging means for selectively securing said top sub to one of said piston means and said mandrel; a plurality of expandable, normally inwardly contracted segmented ring elements carried above said piston and between said top sub and said mandrel to selectively secure said piston to said mandrel; seal means to prevent fluid transmission across said plug assembly and through said packer assembly; upper and lower no-go shoulders on one of said packer body and said expendable plug; segmented, normally expanded but contractible ring elements carried between said no-go shoulders on the other of said packer body and said expendable plug; and disengaging means for selectively securing said segmented ring elements to one of said packer body and said plug assembly.

11. An expendable plug assembly adapted to be selectively secured within a passage of a well packer, said plug assembly comprising: a top sub; a longitudinally extending mandrel; piston means adjacent at least one of said top sub and said mandrel; first disengaging means for selectively securing said top sub to one of said piston means and said mandrel; second disengaging means for selectively securing said top sub to each of said piston means and said mandrel; seal means to prevent fluid transmission across said plug assembly; first and second no-go means on at least one of said main body and said expendable plug; and third disengaging means initially housed within said main body and between said no-go means, said third disengaging means being exterior of at least one of said piston means and said mandrel, said no-go means resisting upper and lower longitudinal movement of said third disengaging means.

12. The plug assembly of claim 11 wherein said first disengaging means secures said top sub to said piston means.

13. The plug assembly of claim 11 wherein said first disengaging means comprises a pin shearable upon application of predetermined force on said plug.

14. The plug assembly of claim 11 wherein said seal means comprises a plurality of elastomerically sealing bodies circumferentially and exteriorally extending around at least one of said top sub, said piston means, and said mandrel, at least one of said elastomerically sealing bodies intially sealingly engaging said main body, said elastomerically sealing bodies preventing fluid flow through said plug and said passage.

15. The plug assembly of claim 11 wherein said first and second no-go means comprise upper and lower shoulders.

16. The plug assembly of claim 11 wherein said first and second no-go means comprise upper and lower shoulders on said main body.

17. The plug assembly of claim 11 wherein said third disengaging means is carried on one of said mandrel, said top sub and said piston means.

18. The plug assembly of claim 11 wherein said third disengaging means is carried on said mandrel.

19. The plug assembly of claim 11 wherein said third disengaging means comprises segmented, normally expanded but contractible ring elements.

20. A well tool assembly adapted to be set in a well bore, comprising: a main body having a passage; means on said main body for securing said main body in the well bore; an expendable plug in said passage to prevent flow of fluid therethrough, said plug comprising: a top sub; a longitudinally extending mandrel; piston means adjacent at least one of said top sub and said mandrel; first disengaging means for selectively securing said top sub to one of said piston means and said mandrel; second disengaging means for selectively securing said top sub to each of said piston means and said mandrel; seal means to prevent fluid transmission across said plug assembly; first and second no-go means on at least one of said main body and said expendable plub; and third disengaging means initially housed within said main body and between said no-go means said third disengaging means being exterior of at least one of said piston means and said mandrel, said no-go means resisting upper and lower longitudinal movement of said third disengaging means, said expendable plug being dischargeable from said main body upon application of weight to said top sub to first activate said first disengaging means, said second disengaging means releasing said top sub and one of said piston means and said mandrel after activation of said first disengaging means, said third disengaging means being shiftable transverse and within said passage of said main body to permit said plug to be discharged therethrough.

21. A well packer assembly adapted to be set in a well bore, comprising: a packer body having a passage; means on said packer body for securing said packer body in the well bore; an expendable plug in said passage to prevent flow of fluid therethrough, said plug comprising: a top sub; a longitudinally extending mandrel; piston means adjacent at least one of said top sub and said mandrel; first disengaging means for selectively securing said top sub to one of said piston means and said mandrel; second disengaging means for selectively securing said top sub to each of said piston means and said mandrel; seal means to prevent fluid transmission across said plug assembly; first and second no-go means on at least one of said main body and said expendable plug; and third disengaging means initially housed within said main body and between said no-go means, said third disengaging means being exterior of at least one of said piston means and said mandrel, said no-go means resisting upper and lower longitudinal movement of said third disengaging means.

22. A well tool assembly adapted to be set in a well bore, comprising: a main body having a passage; means on said main body for securing said main body in the well bore; an expendable plug in said passage to prevent flow of fluid therethrough, said plug comprising: a top sub; a longitudinally extending mandrel; piston means adjacent at least one of said top sub and said mandrel; first disengaging means for selectively securing said top sub to one of said piston means and said mandrel; second disengaging means for selectively securing said top sub to each of said piston means and said mandrel; seal means to prevent fluid transmission across said plug assembly; first and second no-go means on at least one of said main body and said expendable plug; and third disengaging means initially housed within said main body and between said no-go means, said third disengaging means being exterior of at least one of said piston means and said mandrel, said no-go means resisting upper and lower longitudinal movement of said third disengaging means, said expendable plug being dischargeable from said packer assembly upon application of weight to said top sub to first activate said first disengaging means, said second disengaging means releasing said top sub and one of said piston means and said mandrel after activation of said first disengaging means, said third disengaging means being shiftable after activation of said first disengaging means transverse and within said passage of said packer body to permit said plug to be discharged therethrough.

23. A well tool assembly adapted to be set in a well bore, comprising: a main body having a passage; means on said main body for securing said main body in the well bore; an expendable plug in said passage to prevent flow of fluid therethrough, said plug comprising: a top sub; a longitudinally extending mandrel; piston means adjacent at least one of said top sub and said mandrel; first disengaging means for selectively securing said top sub to one of said piston means and said mandrel; second disengaging means for selectively securing said top sub to each of said piston means and said mandrel; seal means to prevent fluid transmission across said plug assembly; first and second no-go means on at least one of said main body and said expendable plug; third disengaging means initially housed within said main body and between said no-go means, said third disengaging means being exterior of at least one of said piston means and said mandrel, said no-go means resisting upper and lower longitudinal movement of said third disengaging means; and means for equalizing pressure across said plug as said plus is being expended from within said body.

24. An expendable plug assembly adapted to be selectively secured within a passage of a well packer, said plug assembly comprising: a top sub; a longitudinally extending mandrel; piston means adjacent at least one of said top sub and said mandrel; first disengaging means for selectively securing said top sub to one of said piston means and said mandrel; second disengaging means for selectively securing said top sub to each of said piston means and said mandrel; seal means to prevent fluid transmission across said plug assembly; first and second no-go means on at least one of said main body and said expandable plug; third disengaging means initially housed within said main body and between said no-go means said third disengaging means being exterior of at least one of said piston means and said mandrel, said no-go means resisting upper and lower longitudinal movement of said third disengaging means; and means for equalizing pressure across said plug assembly as said plug is being expended from within said passage of said well packer.

* * * * *